US007612743B2

(12) United States Patent
Lee et al.

(10) Patent No.: US 7,612,743 B2
(45) Date of Patent: Nov. 3, 2009

(54) ELECTRON EMISSION DISPLAY (EED) WITH DECREASED SIGNAL DISTORTION AND METHOD OF DRIVING EED

(75) Inventors: Ji-Won Lee, Suwon-si (KR); Duck-Gu Cho, Suwon-si (KR)

(73) Assignee: Samsung SDI Co., Ltd., Yeongtong-gu, Suwon-si, Gyeonggi-do (KR)

( * ) Notice: Subject to any disclaimer, the term of this patent is extended or adjusted under 35 U.S.C. 154(b) by 684 days.

(21) Appl. No.: 11/131,321

(22) Filed: May 18, 2005

(65) Prior Publication Data

US 2005/0264222 A1 Dec. 1, 2005

(30) Foreign Application Priority Data

May 28, 2004 (KR) ..... 10-2004-0038177

(51) Int. Cl.
*G09G 3/20* (2006.01)

(52) U.S. Cl. ..... 345/75.2; 345/74.1; 315/160

(58) Field of Classification Search ..... 345/36–39, 345/41–42, 49–67, 74.1–100, 204, 208–214; 315/169.1–169.4, 160
See application file for complete search history.

(56) References Cited

U.S. PATENT DOCUMENTS 6,903,716 B2 * 6/2005 Kawabe et al. ..... 345/99
2001/0043172 A1 * 11/2001 McGrath et al. ..... 345/75.2
2004/0004588 A1 1/2004 Kawase et al.
2005/0264223 A1 * 12/2005 Lee et al. ..... 315/160

FOREIGN PATENT DOCUMENTS

| | | |
|---|---|---|
| JP | 07-181916 | 7/1995 |
| KR | 1998-00082973 | 12/1998 |
| KR | 1999-00026581 | 4/1999 |

OTHER PUBLICATIONS

Office action from the State Intellectural Property Office, P. R. China issued in Applicant's corresponding Chinese Patent Application No. 200510079238.9 dated Sep. 5, 2008.

* cited by examiner

*Primary Examiner*—Richard Hjerpe
*Assistant Examiner*—Mansour M Said
(74) *Attorney, Agent, or Firm*—Robert E. Bushnell, Esq.

(57) ABSTRACT

An Electron Emission Display (EED) with decreased signal distortion has a data driver to convert data driving signals into display data signals having predetermined data voltage levels and to output the display data signals to data electrode lines. A method of driving the EED includes supplying an auxiliary voltage to the data electrode lines during blanking periods according to subsequent data and supplying the display data signals during active periods between the blanking periods.

19 Claims, 8 Drawing Sheets

ELECTRON EMISSION DISPLAY (EED) WITH DECREASED SIGNAL DISTORTION AND METHOD OF DRIVING EED

CLAIM OF PRIORITY

This application makes reference to, incorporates the same herein, and claims all benefits accruing under 35 U.S.C. §119 from an application entitled DRIVING METHOD OF ELECTRON EMISSION DEVICE WITH DECREASED SIGNAL DISTORTION AND DEVICE IMPLEMENTING THEREOF filed with the Korean Intellectual Property Office on May 28, 2004, and there duly assigned Serial No. 10-2004-0038177.

BACKGROUND OF THE INVENTION

1. Field of the Invention

The present invention relates to an Electron Emission Display (EED) with decreased signal distortion and a method of driving the EED, and more particularly, to an EED which can compensate for waveform distortion or signal delay caused by the impedance of an electrode line during a blanking period just before a display data signal is outputted, and a method of driving the EED.

2. Description of the Related Art

An EED includes an EED panel and a driver. When the driver supplies a positive voltage to an anode electrode of the EED panel, if a positive voltage is supplied to a gate electrode and a negative voltage is supplied to a cathode electrode, electrons are emitted from the cathode electrode. The emitted electrons are accelerated toward the gate electrode and converged into the anode electrode. Then, the electrons collide with fluorescent cells disposed in front of the anode electrode, thereby emitting light.

The gate electrodes and the cathode electrodes can be respectively used as scan electrodes and data electrodes, and vice versa.

An EED includes an EED panel and a driver. The driver includes a video processor, a panel controller, a scan driver, a data driver, and a power supply unit.

The video processor converts an external analog video signal into a digital signal to generate an internal video signal, for example, R, G and B video data, a clock signal, and horizontal and vertical synchronization signals.

The panel controller generates data driving control signals and scan driving control signal according to the internal video signal outputted from the video processor. The data driver processes the data driving control signal and generates a display data signal to data electrode lines of the EED panel. The data electrode lines can use cathode electrode lines or gate electrode lines. The scan driver processes the scan driving control signal and supplies the processed signal to scan electrode lines. The scan electrode lines can use the gate electrode lines or the cathode electrode lines.

The power supply unit supplies power to the video processor, the panel controller, the scan driver, the data driver, and an anode electrode of the EED panel.

The operation of the EED is as follows.

It is assumed that the data electrode lines are connected to the cathode electrodes of the EED panel and the scan electrode lines are connected to gate electrodes. A positive voltage is supplied to the anode electrode if a positive voltage is supplied to the gate electrodes through the scan electrode lines and a negative voltage is supplied to the cathode electrodes through the data electrode lines, resulting in electrons being emitted by the cathode electrodes. The emitted electrons are accelerated toward the gate electrodes and converged into the anode electrodes. Then, the electrons collide with fluorescent cells disposed in front of the anode electrodes, thereby emitting light. Alternatively, the data electrode lines and the scan electrode lines can be respectively connected to the gate electrodes and the cathode electrodes.

Gray level control methods for adjusting luminance of the EED panel include a Pulse Width Modulation (PWM) scheme which controls an applying time of data signal pulses and a Pulse Amplitude Modulation (PAM) scheme which controls a voltage amplitude of data signal pulses. According to the PWM scheme, the panel controller generates gray scale signals depending on gray scale information included in the video data. The data driver modulates the pulse width of the data driving signal included in the data driving control signal, depending on the gray scale signals. Then, the PWM-ed signal is boosted to a voltage at which the panel electrodes can be driven, such that the resultant display data signal is outputted to the data electrode lines. According to the PAM scheme, the data driver modulates the pulse amplitude of the data driving signal included in the data driving control signal, depending on the gray scale signals. Then, the PAM-ed signal is boosted to a voltage at which the panel electrodes can be driven, such that the resultant display data signal is outputted to the data electrode lines.

When the display data signal is supplied to the gate electrode lines, a positive display data signal having a voltage Vc exceeding a emission start voltage Vth is supplied at a time point t1 and is ended at a time point t2. Accordingly, electrons must be emitted from the data electrodes at the time point t1.

However, the EED panel has impedance components, such as resistance and capacitance of the electrode lines, depending on environment factors or materials in the manufacturing processes. Thus, pulse waveforms of the data signals or the scan signals supplied to the EED panel can be distorted or delayed. Due to the pulse delay, the luminance of pixels receiving the display data signals can be degraded. Since different luminance is outputted according to the impedance components, the luminance between the pixels receiving the same data signals can also be different.

Due to the delay of the display data signal, the emission start time point is delayed from t1 to t1', and the emission end time point is delayed from t2 to t2'. Energy represented by an area "A1" is not outputted by the EED panel, and an unintended energy represented by an area "A2" is outputted. Since the energy A1 is larger than the energy A2, the luminance emitted by the EED panel is degraded.

A technology for solving the delay and distortion of the display data signal is discussed in Japanese Laid-Open Patent Publication No. 1995/181916. In this patent, a voltage selector is installed within a data driver. The voltage selector additionally modulates a pulse amplitude of a PWM-ed data signal, such that luminance information is added to the PWM-ed data. Thus, the luminance of the panel is increased and the signal delay is reduced. However, when the modulation level of the PAM is large, a fine voltage modulation is still difficult.

In Korean Laid-Open Patent Publication No. 1998/0082973, a negative (−) tab voltage is supplied at a falling edge of a scan voltage, such that a falling width of a scanning voltage becomes large. As a result, a delay time is reduced. However, due to the variation in the amplitude of the voltage, the luminance can be changed differently unlike the purpose of the developer.

Also, U.S. Laid-Open patent Publication No. 2004/0004588 discusses a compensation circuit. In this patent, considering that a emission current is reduced as a time elapses, a gate electrode is driven with a voltage higher than a drive voltage of a reference level, and a FET is coupled to a cathode electrode so that a current greater than a desired current cannot flow. However, since the luminance according to the gray level outputted from a panel is nonlinear with respect to a emission current and a drive voltage, it is impossible to adaptively compensate for a correct drive voltage for outputting a desired luminance. Also, when an excessive drive voltage is supplied to a data electrode, an electron emission source can be easily degraded and the life-span of the device can be shortened.

In Korean Laid-Open Patent Publication No. 1999/0026581, during a predetermined period before a data voltage outputted from a data driver is supplied to each pixel of a panel, a voltage charged at a pixel is previously charged or discharged using a redundant capacitor, such that a time taken to charge a pixel with a data voltage is reduced.

SUMMARY OF THE INVENTION

The present invention provides an EED and a method of driving the EED, which can decrease waveform distortion and signal delay of display data signals caused by the impedance of data electrode lines in an EED panel.

According to one aspect of the present invention, a method of driving an Electron Emission Display (EED) having a data driver to convert data driving signals into display data signals having predetermined data voltage levels and to output the display data signals to data electrode lines is provided, the method comprising: supplying an auxiliary voltage to the data electrode lines during blanking periods according to subsequent data; and supplying the display data signals during active periods between the blanking periods.

Supplying an auxiliary voltage preferably comprises supplying a mid-level voltage in response to the subsequent data being at a high level, and supplying an auxiliary voltage comprises supplying a low-level voltage in response to the subsequent data being at a low level.

An absolute value of the mid-level voltage is preferably lower than a threshold operating voltage of the data electrode lines.

An absolute value of the mid-level voltage is preferably 50% of the high-level voltage supplied to the data electrode lines.

The low-level voltage is preferably a ground voltage.

According to another aspect of the present invention, an Electron Emission Display (EED) is provided comprising: a data driver adapted to convert data driving signals into display data signals having predetermined data voltage levels and to output the display data signals to data electrode lines; a modulator/comparator adapted to modulate sequentially inputted data driving signals into display data signals according to gray scale signals; a high voltage buffer adapted to amplify the modulated display data signals to data voltage levels necessary to drive the data electrode lines; a subsequent data detector adapted to receive subsequent data driving signals with respect to the respective data electrode lines; and a multiplexer adapted to output one of a mid-level voltage and a low-level voltage to the data electrode lines according to the subsequent data driving signals.

The multiplexer is adapted to preferably supply an auxiliary voltage to the data electrode lines during blanking periods according to subsequent data, and the high voltage buffer is adapted to preferably supply the display data signals to the data electrode lines during active periods between the blanking periods.

The multiplexer is preferably adapted to supply a mid-level voltage as the auxiliary voltage to the data electrode lines in response to the subsequent data being at a high level, and the multiplexer is adapted to preferably supply a low-level voltage as the auxiliary voltage to the data electrode lines in response to the subsequent data being at a low level.

An absolute value of the mid-level voltage is preferably lower than a threshold operating voltage of the data electrode lines.

An absolute value of the mid-level voltage is preferably 50% of the high-level voltage supplied to the data electrode lines.

The low-level voltage is preferably a ground voltage.

The modulator/comparator is preferably adapted to Pulse Width Modulate (PWM) or Pulse Amplitude Modulate (PAM) inputted data driving signals according to gray scale signals to generate the display data signals.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
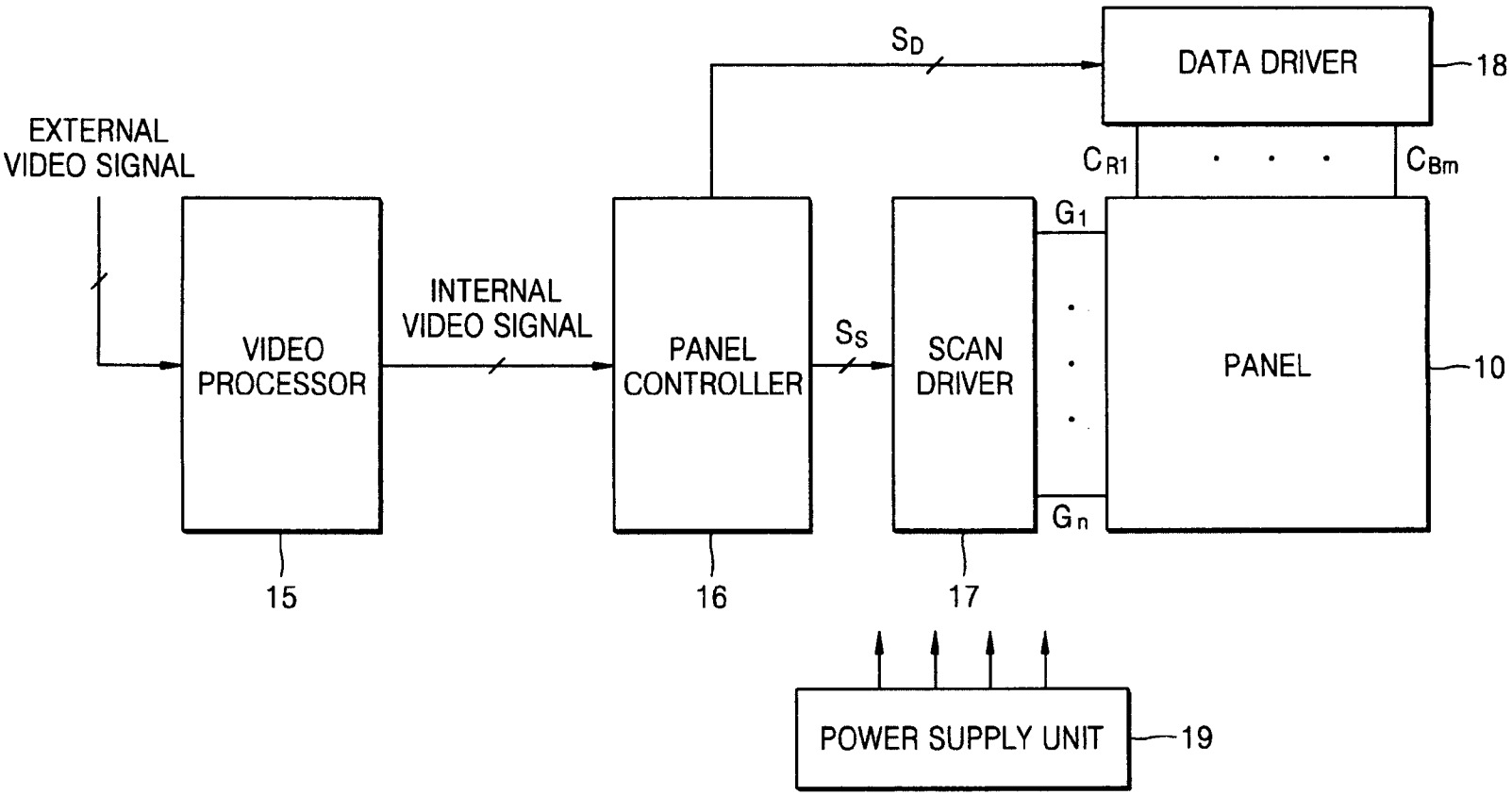
FIG. 1 (PRIOR ART)
FIG. 1 is a block diagram of an EED.

FIG. 1 is a block diagram of an EED.

Referring to FIG. 1, an EED includes an EED panel 10 and a driver. The driver includes a video processor 15, a panel controller 16, a scan driver 17, a data driver 18, and a power supply unit 19.

The video processor 15 converts an external analog video signal into a digital signal to generate an internal video signal, for example, R, G and B video data, a clock signal, and horizontal and vertical synchronization signals.

The panel controller 16 generates data driving control signals SD and scan driving control signal SS according to the internal video signal outputted from the video processor 15. The data driver 18 processes the data driving control signal SD and generates a display data signal to data electrode lines of the EED panel 10. The data electrode lines can use cathode electrode lines $C_{R1}$ to $C_{Bm}$ or gate electrode lines $G_1$ to $G_n$. The scan driver 17 processes the scan driving control signal $S_S$ and supplies the processed signal to scan electrode lines. The scan electrode lines can use the gate electrode lines $G_1$ to $G_n$ or the cathode electrode lines $C_{R1}$ to $C_{Bm}$.

The power supply unit 19 supplies power to the video processor 15, the panel controller 16, the scan driver 17, the data driver 18, and an anode electrode of the EED panel 10.

The operation of the EED is as follows.

It is assumed that the data electrode lines are connected to the cathode electrodes $C_{R1}$ to $C_{Bm}$ of the EED panel 10 and the scan electrode lines are connected to gate electrodes $G_1$ to $G_n$. A positive voltage is supplied to the anode electrode if a positive voltage is supplied to the gate electrodes $G_1$ to $G_n$ through the scan electrode lines and a negative voltage is supplied to the cathode electrodes $C_{R1}$ to $C_{Bm}$ through the data electrode lines, resulting in electrons being emitted by the cathode electrodes. The emitted electrons are accelerated toward the gate electrodes and converged into the anode electrodes. Then, the electrons collide with fluorescent cells disposed in front of the anode electrodes, thereby emitting light. Alternatively, the data electrode lines and the scan electrode lines can be respectively connected to the gate electrodes $G_1$ to $G_n$ and the cathode electrodes $C_{R1}$ to $C_{Bm}$.

Gray level control methods for adjusting luminance of the EED panel 10 include a Pulse Width Modulation (PWM) scheme which controls an applying time of data signal pulses and a Pulse Amplitude Modulation (PAM) scheme which controls a voltage amplitude of data signal pulses. According to the PWM scheme, the panel controller 16 generates gray scale signals depending on gray scale information included in the video data. The data driver 18 modulates the pulse width of the data driving signal included in the data driving control signal SD, depending on the gray scale signals. Then, the PWM-ed signal is boosted to a voltage at which the panel electrodes can be driven, such that the resultant display data signal is outputted to the data electrode lines. According to the PAM scheme, the data driver 18 modulates the pulse amplitude of the data driving signal included in the data driving control signal SD, depending on the gray scale signals. Then, the PAM-ed signal is boosted to a voltage at which the panel electrodes can be driven, such that the resultant display data signal is outputted to the data electrode lines.

Figure 2:
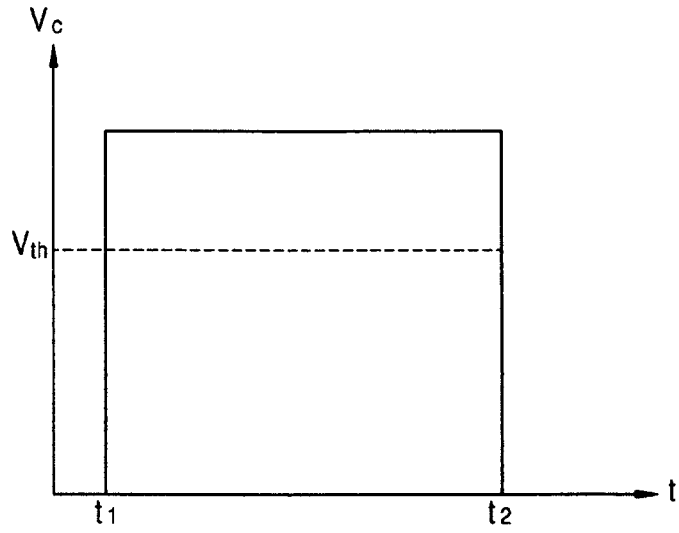
FIG. 2 (PRIOR ART)
FIG. 2 is an ideal pulse waveform of a display data signal supplied to an EED panel.
Figure 3:
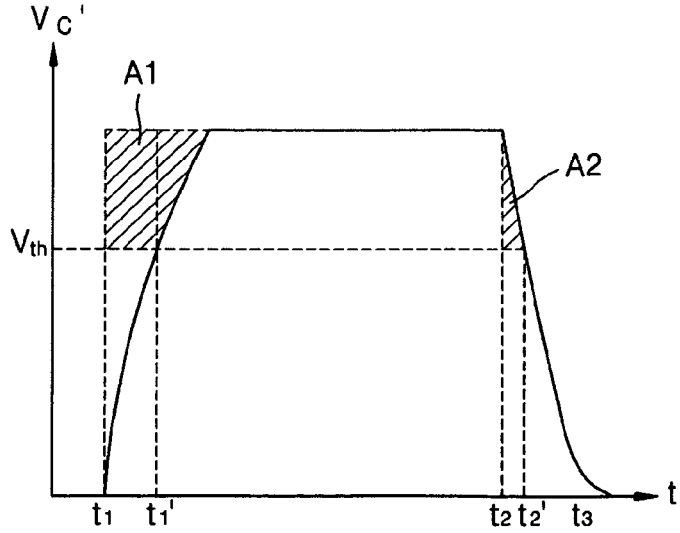
FIG. 3 (PRIOR ART)
FIG. 3 is a pulse waveform of a signal distorted or delayed due to impedance components of the electrode lines in an EED panel.

FIG. 2 is an ideal pulse waveform of the display data signal supplied to the EED panel, and FIG. 3 is a pulse waveform of a signal distorted or delayed due to impedance components of the electrode lines in the EED panel.

When the display data signal is supplied to the gate electrode lines $G_1$ to $G_n$, the positive display data signal is supplied as shown in FIG. 2. Referring to FIG. 2, a display data signal having a voltage Vc exceeding a emission start voltage Vth is supplied at a time point t1 and is ended at a time point t2. Accordingly, electrons must be emitted from the data electrodes at the time point t1.

However, the EED panel 10 has impedance components, such as resistance and capacitance of the electrode lines, depending on environment factors or materials in the manufacturing processes. Thus, pulse waveforms of the data signals or the scan signals supplied to the EED panel 10 can be distorted or delayed. Due to the pulse delay, the luminance of pixels receiving the display data signals can be degraded. Since different luminance is outputted according to the impedance components, the luminance between the pixels receiving the same data signals can also be different.

Referring to FIG. 3, due to the delay of the display data signal, the emission start time point is delayed from t1 to t1', and the emission end time point is delayed from t2 to t2'. Energy represented by an area "A1" is not outputted by the EED panel, and an unintended energy represented by an area "A2" is outputted. Since the energy A1 is larger than the energy A2, the luminance emitted by the EED panel is degraded.

The present invention will now be described more fully with reference to the accompanying drawings, in which exemplary embodiments of the invention are shown.

Figure 4:
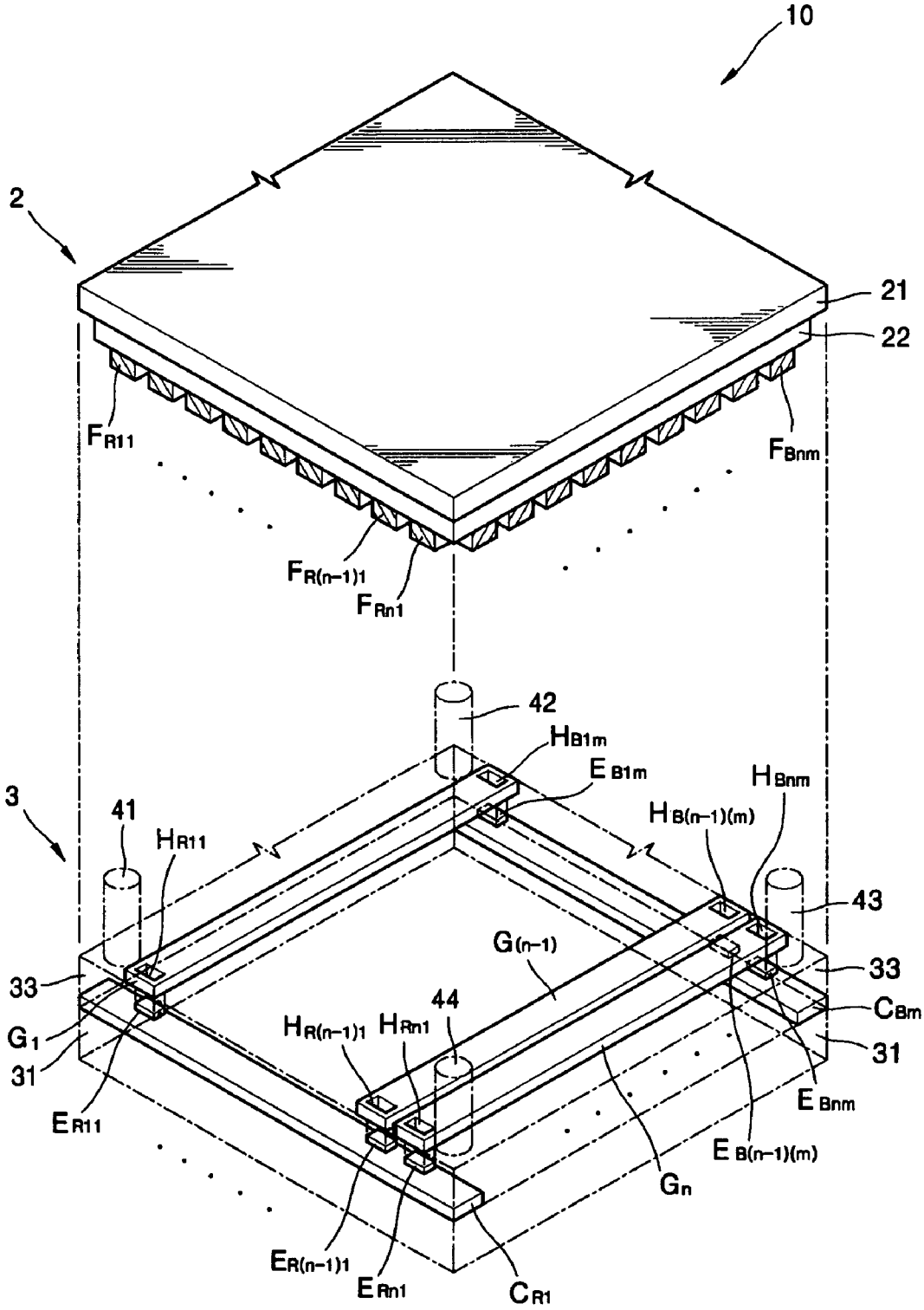
FIG. 4 is a perspective view of an EED panel in an EED according to an embodiment of the present invention.

FIG. 4 is a perspective view of an EED panel in an EED according to an embodiment of the present invention.

Referring to FIG.4, an EED panel 10 includes a front panel 2 and a rear panel 3, which are supported by space bars 41 to 43.

The rear panel 3 includes a rear substrate 31, cathode electrode lines $C_{R1}$ to $C_{Bm}$, electron emitting sources ER11 to EBnm, an insulating layer 33, and gate electrode lines $G_1$ to Gn.

Data signals are supplied to the cathode electrode lines $C_{R1}$ to $C_{Bm}$. The cathode electrode lines $C_{R1}$ to $C_{Bm}$ are electrically connected to the electron emitting sources $E_{R11}$ to $E_{Bnm}$. Through-holes $H_{R11}$ to HBnm corresponding to the electron emitting sources $E_{R11}$ to $E_{Bnm}$ are formed at a first insulating layer 33 and the gate electrode lines $G_1$ to $G_n$. The through-holes $H_{R11}$ to $H_{Bnm}$ are formed at areas where the cathode electrode lines $C_{R1}$ to $C_{Bm}$ intersect with the gate electrode lines $G_1$ to $G_n$ to which scan signals are supplied.

The front panel 2 includes a front transparent substrate 21, an anode electrode 22, and fluorescent cells FR11 to FBnm. A high positive voltage of 1-4 KV is supplied to the anode electrode 22, allowing the electrons to move from the electron emitting sources ER11 to EBnm to the fluorescent cells.

Figure 5:
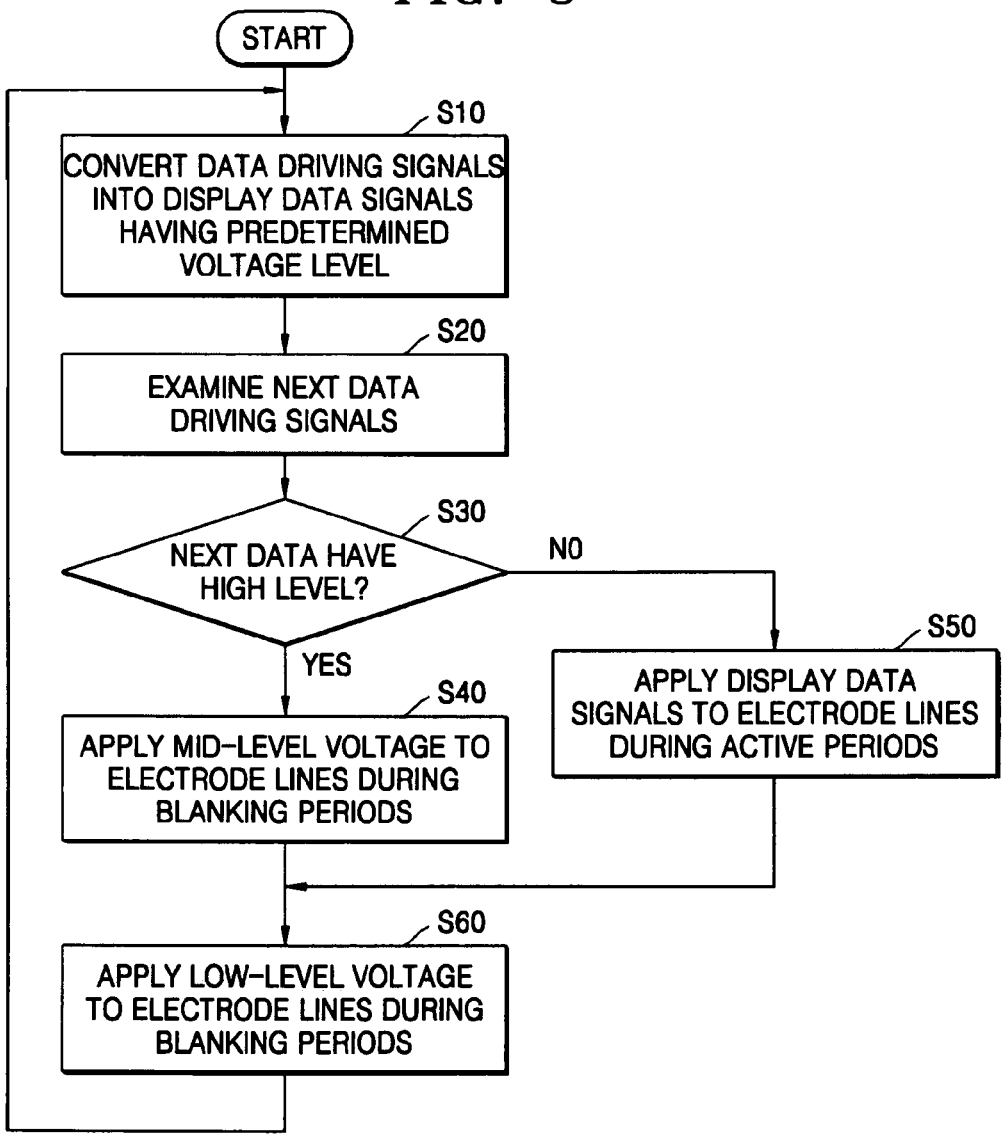
FIG. 5 is a flowchart of a driving method of an EED device according to an embodiment of the present invention.
Figure 6A:
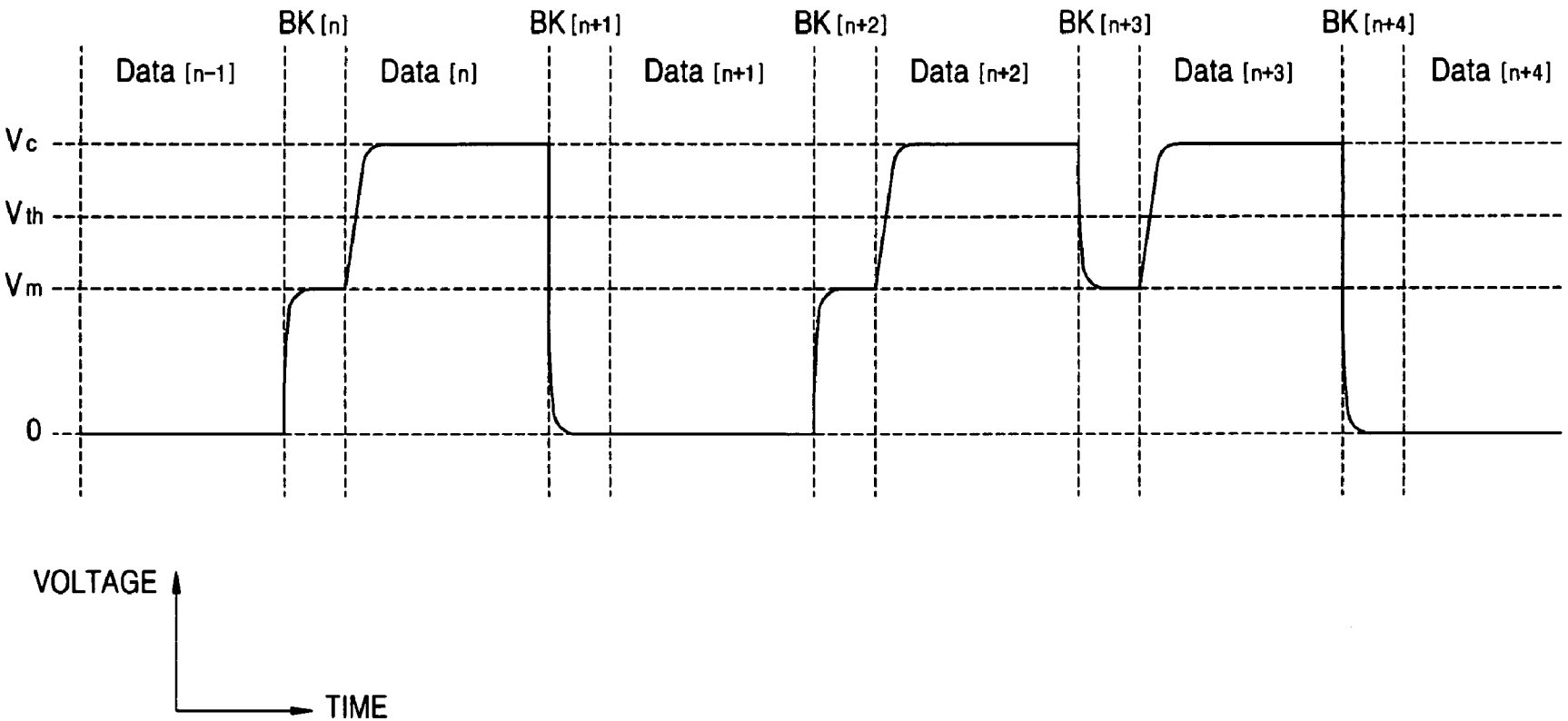
FIGS. 6A and 6B are waveforms of a method of driving an EED according an embodiment of the present invention.
Figure 6B:
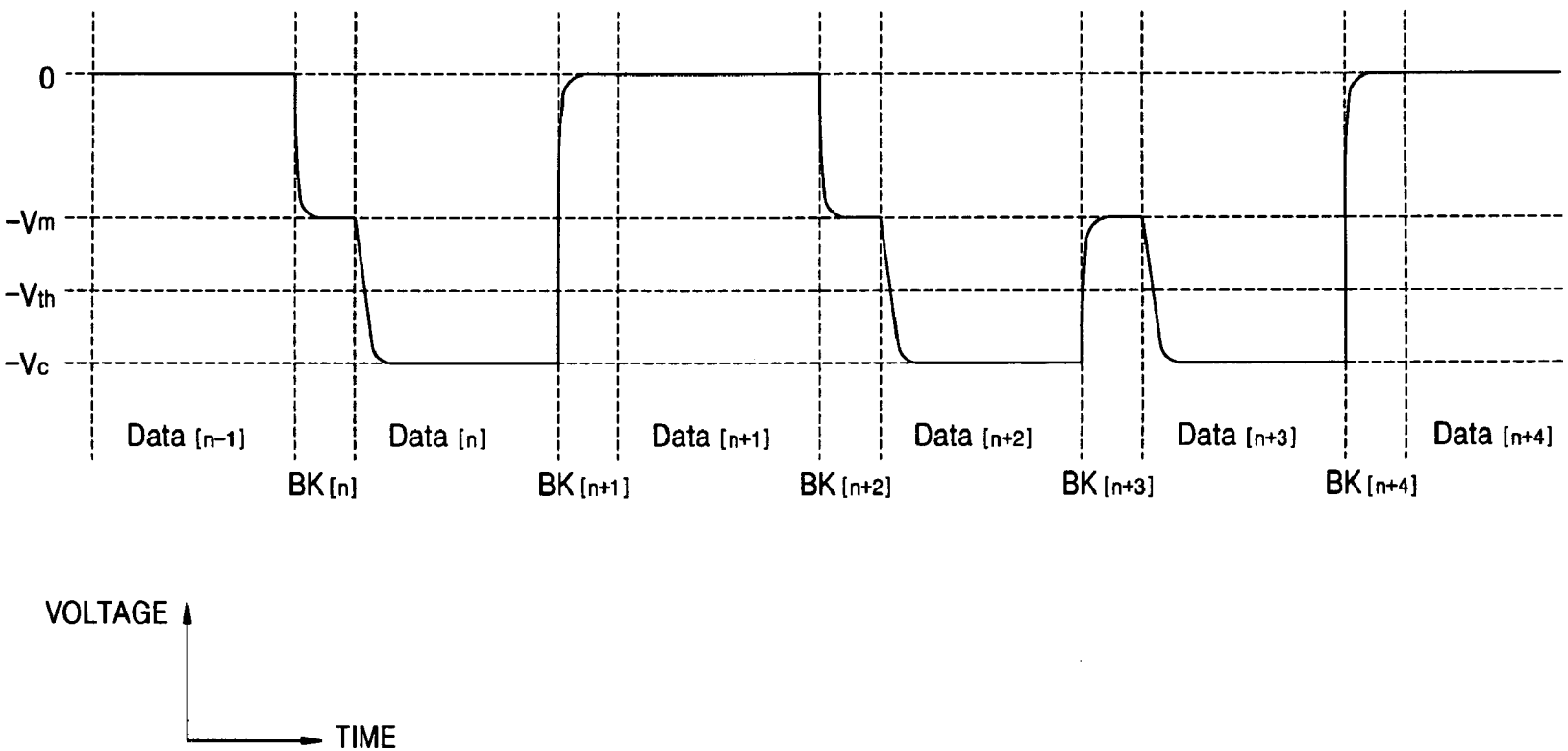

FIG. 5 is a flowchart of a driving method of an EED device according to an embodiment of the present invention. FIGS. 6A and 6B are waveforms of voltages of display data signals supplied to the data electrode lines with respect to time. In detail, FIG. 6A is a waveform when the gate electrodes and the cathode electrodes are respectively connected to the data electrode lines and the scan electrode lines, and FIG. 6B is a waveform when the cathode electrodes and the data electrodes are respectively connected to the data electrode lines and the scan electrode lines.

First, data driving signals are converted into display data signals having predetermined voltage levels (S10). The data driving signals are control driving signals for the display data signals supplied to the electrode lines. For example, the data driving signals are converted into the display data signals by performing the PWM or PAM process in proportion to gray scale information within the data driver and boosted into high voltages having levels necessary for driving the electrode lines.

Then, a determination is made as to which kind of data a subsequent data driving signal has (S20). That is, a determination is made as to whether the subsequent data driving signal has high-level display data or low-level display data (S30).

If the next display data has a high level due to the subsequent data driving signal, a mid-level voltage $V_M$ is supplied as an auxiliary voltage to the data electrode line during a blanking period (S40). It is preferable that the mid-level voltage $V_M$ is lower than a emission start voltage $V_{th}$ of the data electrode line because an unintended electron emission must not occur due to the mid-level voltage $V_M$. Also, it is preferable that the mid-level voltage $V_M$ is about 50% of a maximum emission voltage.

The display data signal is supplied to the data electrode line during an active period just after the blanking period (S60). Because a voltage has already risen as much as the mid-level voltage $V_M$ during the blanking period just before the active period, it rises more rapidly up to a voltage level of a desired display data signal, thereby decreasing a rising time.

In step S30, like Data {n+1} of FIG. 6A, if the next display data has a low level due to the subsequent data driving signal, a low-level voltage $V_L$ is supplied to the electrode line during the blanking period (S50). Although it is preferable that the low-level voltage $V_L$ is a ground voltage, it can also be higher or lower than the ground voltage according to design specifications. When a time constant of an impedance of the data electrode is large, a falling time can be reduced by applying a predetermined reverse voltage.

The display data signal is supplied to the data electrode line during the active period just after the blanking period (S60). In FIG. 6A, because a voltage has already risen as much as the mid-level voltage $V_M$ during the blanking period just before the active period, it rises more rapidly up to a voltage level of a desired display data signal, thereby decreasing a rising time.

Accordingly, during the blanking period just before the active period, the rising or falling time when the display data signal of the subsequent data is supplied to the data electrode lines can be decreased by applying the predetermined auxiliary voltage to the data electrode line according to the subsequent data. Thus, the waveform distortion or the signal delay can be reduced.

For example, referring to FIG. 6A, a display data signal due to an n-th data driving signal Data {n} is outputted during an n-th active period, and an n-th auxiliary voltage applying pulse BK {n} is present during the blanking period just before the n-th active period.

The mid-level voltage $V_M$ corresponding to half of the maximum supplied voltage $V_C$ is supplied during the blanking period just before the n-th active period. Accordingly, when the n-th active period at which the display data signal must be outputted is started, the display data signal has already reached the mid-level voltage $V_M$. Thus, during the n-th active period, the display data signal can rise rapidly up to the maximum supplied voltage $V_C$ without any influence of the waveform distortion and signal delay.

Then, the low-level voltage VL is supplied during the blanking period just before a (n+1)-th active period. Accordingly, when the (n+1)-th active period at which the display data signal must be outputted is started, the display data signal has already reached the low-level voltage VL.

Referring to FIG. 6B, when the data electrode lines are connected to the cathode electrode lines, the mid-level voltage $V_M$ corresponding to half of the maximum supplied voltage $V_C$ is supplied during the blanking period just before the n-th active period. Accordingly, when the n-th active period at which the display data signal must be outputted is started, the display data signal has already reached the mid-level voltage $V_M$. Thus, during the n-th active period, the display data signal can rapidly fall down to the maximum supplied voltage $V_C$ without any influence of the waveform distortion and signal delay.

Then, the low-level voltage VL is supplied during the blanking period just before a (n+1)-th active period. Accordingly, when the (n+1)-th active period at which the display data signal must be outputted is started, the display data signal has already reached the low-level voltage VL. Because a voltage has already risen as much as the low-level voltage VL during the blanking period just before the active period, it rises more rapidly up to a voltage level of a desired display data signal, thereby decreasing a rising time.

An EED according to an embodiment of the present invention is described below with reference to the accompanying drawings.

Figure 7:
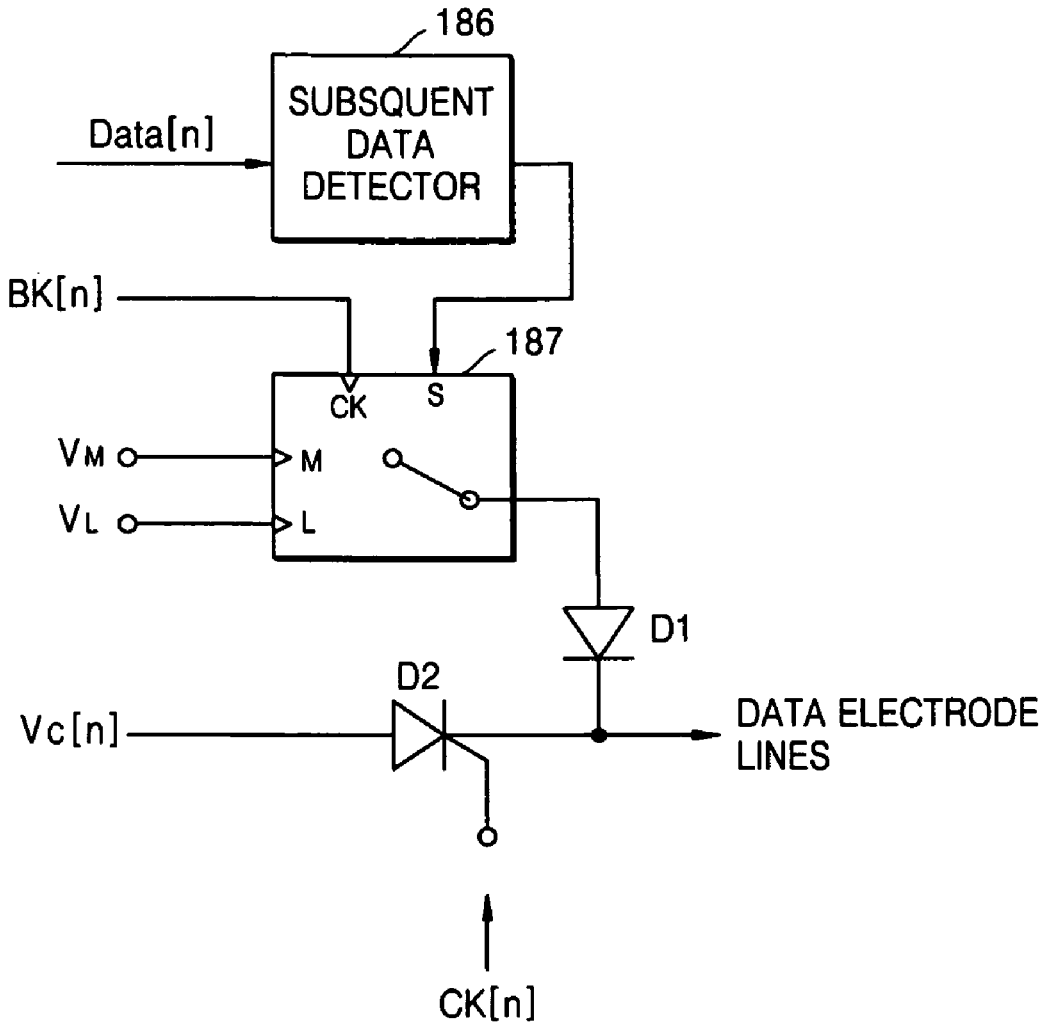
FIG. 7 is a block diagram of a subsequent data detector and a multiplexer of an EED according to an embodiment of the present invention.

FIG. 7 is a block diagram of a subsequent data detector 186 and a multiplexer 187 of an EED according to an embodiment of the present invention.

Referring to FIG. 7, a subsequent data detector 186 receives a data driving signal Data {n} and determines whether a corresponding subsequent data is a high level or a low level. For example, a select signal of "1" is outputted when the subsequent data is a high level, and a select signal of "0" is outputted when the subsequent data is a low level.

The select signal is inputted to a select signal input terminal S of the multiplexer 187. The multiplexer 187 selects one of the mid-level voltage $V_M$ and the low-level voltage $V_L$ as the auxiliary voltage and outputs the selected voltage to the data electrode line. For example, the multiplexer 187 outputs the mid-level voltage $V_M$ to the data electrode line when the inputted select signal is "1", and the multiplexer 187 outputs the low-level voltage VL to the data electrode line when the inputted select signal is "0". The multiplexer 187 receives the auxiliary voltage applying pulse BK {n} at every blanking time and outputs the auxiliary voltage to the data electrode line.

During the active period just after the blanking period, the display data signal Vc {n} having a desired voltage level Vc is supplied to the data electrode line. Although the display data signal is generally supplied to a high voltage buffer (189 in FIG. 8) of the data driver 18, the present invention is not limited thereto. That is, the display data signal can be supplied by an active signal CK {n}. For this purpose, as shown in FIG. 7, a thyristor D2 can be provided so that the display data signal can be outputted only while the active signal CK {n} is supplied and the auxiliary voltage cannot influence the high voltage buffer.

It is preferable that a diode D1 is provided at an output terminal of the multiplexer 187 so that the display data signal Vc {n} of a high voltage cannot flow into the multiplexer 187.

Figure 8:
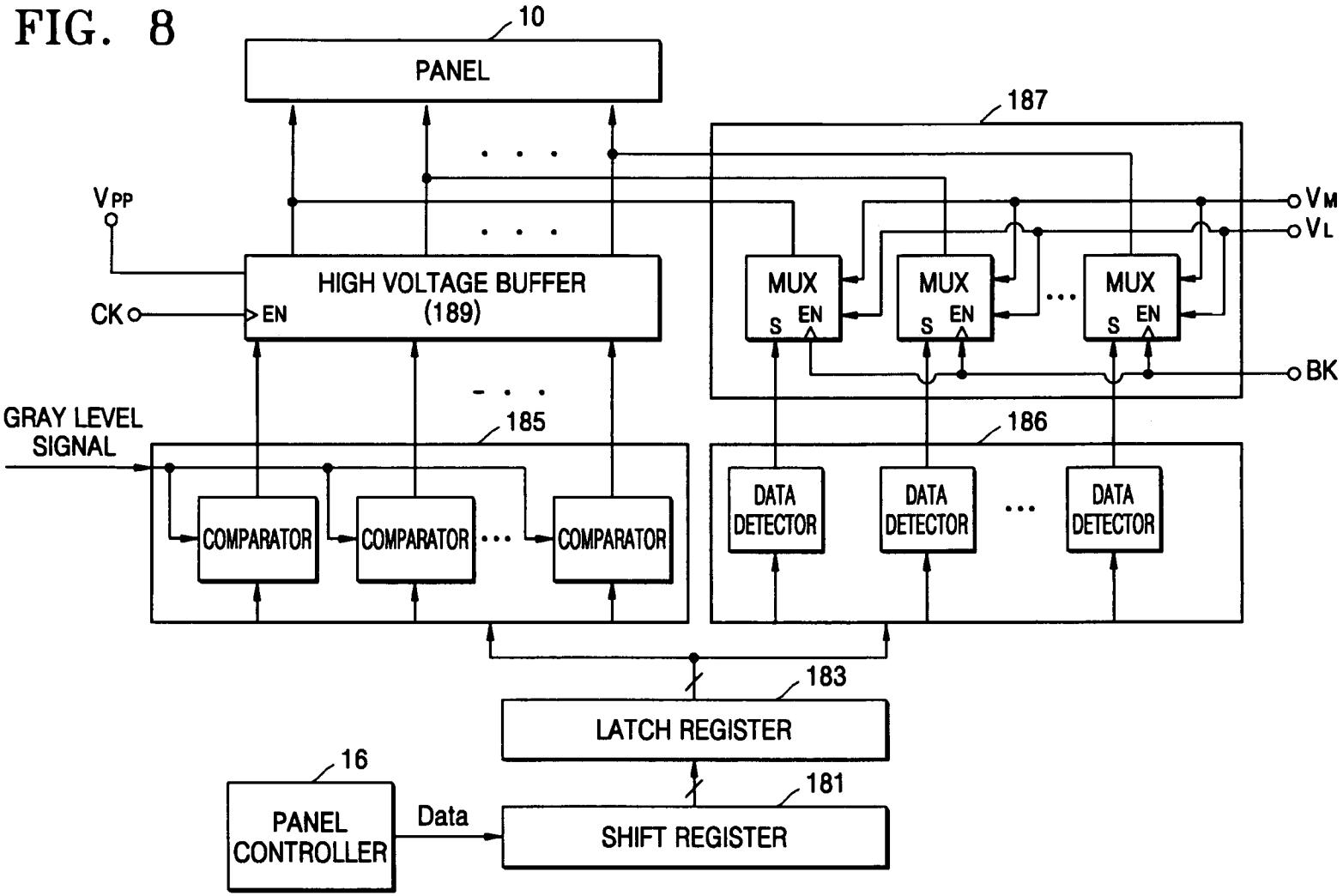
FIG. 8 is a block diagram of a data driver of an EED according to an embodiment of the present invention.

FIG. 8 is a block diagram of the data driver of the EED according to an embodiment of the present invention.

In the EED according to the present invention, the data driving signals are converted into the display data signals having predetermined data voltage levels by the data driver, and the display data signals are outputted to the data electrode lines of the EED panel.

Referring to FIG. 8, the data driver 18 includes a shift register 181 for receiving data driving signals Data, a latch register 183 for temporarily storing in parallel a set of the data driving signals Data, a modulation/comparison part 185 for outputting parallel video signals every when the parallel video signals coincide with the gray scale signals, and a high voltage buffer 189 for outputting the modulated signals to the data electrode lines.

The shift register 181 sequentially receives and stores data driving signals of a first horizontal line. The data driving signals are inputted from the panel controller 16. The shift register 181 of the data driver 18 stores serial data driving signals of the first horizontal line and outputs parallel data driving signals. The latch register 183 stores the parallel data driving signals of the first horizontal line from the shift register 181 and outputs them to the modulator/comparator 185 at the same time when, for example, an output enable signal is received.

The modulator/comparator 185 compares the parallel data driving signals of the latch register 183 with the gray scale signals and performs a PWM or PAM process when the parallel data driving signals coincide with the gray scale signals. Then, the modulator/comparator 185 outputs the parallel data driving signals as the display data signals to the data electrode lines.

The modulated data signals can pass through a predetermined logic gate set. For example, when the data electrode lines are the cathode electrodes $C_{R1}$ to $C_{Bm}$, the voltage pulses of the data signals can be inverted in a reversed phase. The high voltage buffer 189 increases a level of the modulated display data signal up to a high voltage level corresponding to the electrodes (for example, the cathode electrodes or the gate electrodes) connected to the data electrode lines. That is, the high voltage buffer 189 amplifies the modulated display data signals up to the data voltage levels at which the data electrode lines can be driven.

The subsequent data detector 186 is illustrated on the right side of FIG. 8. The subsequent data detector 186 receives the parallel data driving signals from the latch register 183 and examines the subsequent data driving signals. The subsequent data detector 186 includes a plurality of data detectors corresponding to the data electrode lines.

The subsequent data detector 186 outputs a voltage select signal to the multiplexer 187. The multiplexer 187 receives the mid-level voltage $V_M$ and the low-level voltage $V_L$ as the auxiliary voltages. Then, the multiplexer 187 outputs one of the mid-level voltage $V_M$ and the low-level voltage $V_L$ to the data electrode lines in response to the select signal inputted from the subsequent data detector 186 through the select signal input terminal S. The multiplexer 187 outputs the auxiliary voltage when receiving the auxiliary voltage applying pulse BK, which is supplied only during the blanking period.

The high voltage buffer 189 supplies the display data signals to the data electrode lines during the active periods between the blanking periods. For example, the high voltage buffer 189 supplies the display data signals when receiving the active signal CK indicative of the active period.

In supplying the auxiliary voltage, the multiplexer 187 supplies the mid-level voltage to the data electrode lines when the subsequent data is a high level, and supplies the low-level voltage to the data electrode lines when the subsequent data is a low level. For example, when the inputted select signal is a "1", the multiplexer 187 outputs the mid-level voltage $V_M$ to the data electrode lines. When the inputted select signal is a "0", the multiplexer 187 outputs the low-level voltage $V_L$ to the data electrode lines. An absolute value of the mid-level voltage must be lower than the threshold voltage at which the data electrode lines operate. Also, it is preferable that the absolute value of the mid-level voltage is 50% of the high-level voltage supplied to the data electrode lines. Although the low-level voltage $V_L$ is a ground voltage, it can also be higher or lower than the ground voltage by a predetermined electrical potential according to design specifications. If a time constant of an impedance of the data electrode is large, a predetermined reversed voltage is supplied. In this manner, when the subsequent data is a low level, a falling time (a rising time when the data electrode lines are the gate electrode lines) can be decreased.

As described above, in the EED having the data driver 18, when the n-th data is a high level, the multiplexer 187 supplies in advance the mid-level voltage having 50% of the high-level voltage to the data electrode lines during the blanking period, and supplies the PWM-ed or PAM-ed data driving signals during the active period just after the blanking period.

Accordingly, as in FIG. 6A (when the data electrode lines are the gate electrode lines) or FIG. 6B (when the data electrodes are the cathode electrode lines), the compensated waveforms are supplied to the data electrode lines. Thus, the rising or falling time of the signals supplied to the data electrode lines is decreased, such that the waveform distortion or the signal delay due to the impedance of the data electrode lines can be reduced.

The present invention can prevent the degradation of the luminance which is caused by the waveform distortion and the signal delay due to the impedance of the panel electrode lines, thereby increasing the luminance and the energy efficiency.

Also, the present invention can prevent any nonuniformity of the luminance between the pixels to which the same data is supplied. That is, the waveform distortion according to the impedance of the data electrode lines is greatly reduced, thereby reducing the nonuniformity of the luminance between the up and down, right and left pixels to which the same data is supplied.

Furthermore, the present invention can decrease the rising or falling time of the display data signals supplied to the pixels during the active period, thereby increasing the driving speed of the panel.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A method of driving an Electron Emission Display (EED) having a data driver to convert data driving signals into display data signals having predetermined data voltage levels and to output the display data signals to data electrode lines, the method comprising the steps of:

supplying an auxiliary voltage to the data electrode lines during blanking periods according to subsequent data; and supplying the display data signals during active periods between the blanking periods;

wherein the step of supplying the auxiliary voltage comprises supplying a mid-level voltage when the subsequent data will be at a high level, and supplying a low-level voltage when the subsequent data will be at a low level.

2. The method of claim 1, wherein an absolute value of the mid-level voltage is lower than a threshold operating voltage of the data electrode lines.

3. The method of claim 1, wherein an absolute value of the mid-level voltage is 50% of the high-level voltage supplied to the data electrode lines.

4. The method of claim 1, wherein the low-level voltage is a ground voltage.

5. An Electron Emission Display (EED), comprising:

a data driver for converting data driving signals into display data signals having predetermined data voltage levels, and for outputting the display data signals to data electrode lines;

a modulator/comparator for modulating sequentially inputted data driving signals into display data signals according to gray scale signals;

a high voltage buffer for amplifying the modulated display data signals to data voltage levels necessary to drive the data electrode lines;

a subsequent data detector for receiving subsequent data driving signals with respect to the respective data electrode lines; and a multiplexer for outputting one of a mid-level voltage and a low-level voltage to the data electrode lines according to the subsequent data driving signals.

6. The EED of claim 5, wherein the multiplexer supplies an auxiliary voltage to the data electrode lines during blanking periods according to subsequent data, and the high voltage buffer supplies the display data signals to the data electrode lines during active periods between the blanking periods.

7. The EED of claim 6, wherein the multiplexer supplies a mid-level voltage as the auxiliary voltage to the data electrode lines when the subsequent data will be at a high level, and the multiplexer supplies a low-level voltage as the auxiliary voltage to the data electrode lines when the subsequent data will be at a low level.

8. The EED of claim 7, wherein an absolute value of the mid-level voltage is lower than a threshold operating voltage of the data electrode lines.

9. The EED of claim 7, wherein an absolute value of the mid-level voltage is 50% of the high-level voltage supplied to the data electrode lines.

10. The EED of claim 7, wherein the low-level voltage is a ground voltage.

11. The EED of claim 5, wherein the modulator/comparator performs one of Pulse Width Modulation (PWM) and Pulse Amplitude Modulation (PAM) on inputted data driving signals according to gray scale signals so as to generate the display data signals.

12. A method of driving an Electron Emission Display (EED), comprising the steps of:

(a) converting data driving signals into display data signals having predetermined data voltage levels and outputting the display data signals to data electrode lines;

(b) modulating sequentially inputted data driving signals into display data signals according to gray scale signals;

(c) amplifying the modulated display data signals to data voltage levels necessary to drive the data electrode lines;

(d) receiving subsequent data driving signals with respect to the respective data electrode lines; and (e) outputting one of a mid-level voltage and a low-level voltage to the data electrode lines according to the subsequent data driving signals.

13. The method of claim 12, wherein step (c) comprises supplying the display data signals to the data electrode lines during active periods between the blanking periods.

14. The method of claim 12, wherein step (e) comprises supplying an auxiliary voltage to the data electrode lines during blanking periods according to subsequent data.

15. The method of claim 14, wherein step (e) further comprises supplying a mid-level voltage as the auxiliary voltage to the data electrode lines when the subsequent data will be at a high level, and supplying a low-level voltage as the auxiliary voltage to the data electrode lines when the subsequent data will be at a low level.

16. The method of claim 15, wherein an absolute value of the mid-level voltage is lower than a threshold operating voltage of the data electrode lines.

17. The method of claim 15, wherein an absolute value of the mid-level voltage is 50% of the high-level voltage supplied to the data electrode lines.

18. The method of claim 15, wherein the low-level voltage is a ground voltage.

19. The method of claim 12, wherein step (b) comprises performing one of Pulse Width Modulation (PWM) and Pulse Amplitude Modulation (PAM) on inputted data driving signals according to gray scale signals to generate the display data signals.

* * * * *